US005427291A

United States Patent [19]

Smith

[11] Patent Number: 5,427,291

[45] Date of Patent: Jun. 27, 1995

[54] SKI CARRIER AND METHOD EMPLOYING SAME

[76] Inventor: David S. Smith, P.O. Box 1431, Dundee, Fla. 33838

[21] Appl. No.: 126,520

[22] Filed: Sep. 21, 1993

[51] Int. Cl.[6] ..... A63C 11/02

[52] U.S. Cl. ..... 224/250; 224/205; 224/258; 224/917; 280/814; 294/147; 294/149

[58] Field of Search ..... 224/202, 205, 218, 250, 224/257, 258, 917; 280/814; 294/146, 147, 149, 150, 152, 157

[56] References Cited

U.S. PATENT DOCUMENTS

| | | | |
|---|---|---|---|
| D. 283,758 | 5/1986 | Stewart et al. | 224/202 X |
| 3,275,205 | 9/1966 | Howd et al. | 224/250 X |
| 3,590,608 | 7/1971 | Smyth | 280/814 X |
| 3,768,711 | 10/1973 | Wilkinson . | |
| 3,841,542 | 10/1974 | Hogensen, Jr. . | |
| 3,960,302 | 6/1976 | Mazzoni, Jr. . | |
| 4,015,762 | 4/1977 | Mendillo | 294/149 |
| 4,114,838 | 9/1978 | Knauf . | |
| 4,261,493 | 4/1981 | Newman | 224/257 |
| 4,531,661 | 7/1985 | Santy | 224/917 X |
| 4,676,417 | 6/1987 | Hirschkoff | 224/202 |
| 4,856,689 | 8/1989 | Shore | 224/218 |
| 4,867,478 | 9/1989 | Anderson | 280/814 |
| 4,911,347 | 3/1990 | Wilhite | 224/257 |
| 5,056,819 | 10/1991 | Hayes | 280/809 |
| 5,056,820 | 10/1991 | Des Prez | 280/814 |
| 5,104,017 | 4/1992 | Vandagriff | 224/205 |
| 5,234,144 | 8/1993 | Iler | 224/202 X |

FOREIGN PATENT DOCUMENTS

| | | | |
|---|---|---|---|
| 2577123 | 8/1986 | France | 294/147 |
| 3128920 | 2/1983 | Germany | 224/257 |

*Primary Examiner*—J. Casimer Jacyna

*Attorney, Agent, or Firm*—Warren L. Franz; James H. Beusse

[57] ABSTRACT

A ski carrier has a strap with opposite end portions having overlapping ends formed into eyelets. Separable segments are brought through the eyelets to form ski carrying loops at toe and heel ends of outwardly facing bindings of skis aligned in tandem, back-to-back positions. After forming loops, segments are joined by mating male and female elements of a snapping fastener. Ski poles are brought through an opening of a tie loop attached to one element, and a spring-loaded barrel lock closes loop about the poles. Skis are carried by lifting carrier with the hand around fastener and poles. The lifting causes loops to self-tighten about the skis against the outward bias of the ski camber.

12 Claims, 3 Drawing Sheets

SKI CARRIER AND METHOD EMPLOYING SAME

This invention relates to carriers for skis; and more particularly, to a ski carrier having continuously self-adjusting ski carrying loops and a hand grippable pole tie that doubles as an aid for converting the carrier into a compact bundle for storage.

BACKGROUND OF THE INVENTION

Skis are conveniently carried in bottom in/binding out, back-to-back longitudinally parallel relationship, gripping them centrally over a balanced moment arm, center of mass carrying point. Ski poles are conveniently carried in longitudinally parallel alignment with the skis. Skis must be oriented in vertical tandem, back-to-back positions to fit into ski carrying tubes mounted externally on the back of ski area buses.

Examples of ski carriers for assisting the hand carrying of skis and poles in the described carrying positions are shown in U.S. Pat. Nos. 3,768,711; 3,841,542; 3,960,302; 4,114,838; 4,676,417; 5,056,819; 5,056,820; and 5,104,017. These illustrative carriers have nylon cords, webbing straps, lengths of fabric, strips of rubber material or the like (hereafter "straps") which wrap around the skis to form loops within which to carry the skis. The skis are placed in tandem back-to-back positions and the carrying loops formed by passing ends of the straps around the skis and securing them by Velcro TM -type or other releasable attachment means to selected attachment points on the same straps. The loops are typically hand adjustable; however, once the attachment points have been selected, the loop sizes remain fixed. Fixing the sizes too loosely enables the skis to slip, thereby making carrying the skis in a vertical position difficult. Tight loops flatten out ski curvature (viz. camber), thereby reducing useful life of the skis.

Various arrangements are made in conventional carriers for also carrying the poles. Placing the poles within the ski carrying loops, as done in the '711 and '417 patents, can cause the loops to loosen about the skis, should the poles slip. Providing slots or separate loops separate from the ski carrying loops, as done in the '302 and '838 patents, is clumsy and interferes with the central balance for carrying of the skis. Holding the skis as done in the '820 patent avoids the imbalance problem, but has the disadvantage that the entire weight of the skis is applied in bending moments about the centers of the poles.

The '542, '838, '417 and '017 patents also illustrate known means for transporting a ski carrier when not in use. The '542 and '417 devices can be transformed into belts to be worn around the waist. The '017 device is folded and stored in a separate bag. In '838, the device can be folded into a compact bundle for placement into a pocket. The '542 device, however, utilizes metal buckles that may be difficult to grip or manipulate with the gloved hand and that provide hard jutting ends against which the skis may fall. The '417 and '838 devices, on the other hand, utilize Velcro TM closures which operate inefficiently when wet with snow, or else grab woolen articles of the skier's clothing or tissues and other articles within the skier's pockets. The '017 device is bulky.

SUMMARY OF THE INVENTION

The invention provides a ski carrier comprising a strap having opposite end portions formed into self-adjusting ski carrying loops which wrap around longitudinally spaced locations on skis placed in tandem back-to-back positions. The strap includes an intermediate portion comprising normally connected first and second segments, and centrally located means for temporarily disconnecting the first and second segments so that connecting central parts of the segments can be brought through eyelet openings at the opposite end portions to form the ski carrying loops. A tie loop and means for selectively adjusting the size of the tie loop are carried by the strap first and second segment disconnecting means, and provide a mechanism for securely holding a pair of ski poles in longitudinal alignment with the tandem skis, so that the hand may be closed about both the tie held poles and the strap intermediate portion. The tie loop and tie loop size adjustment means also serve to bind the strap in a compact, tightly wrapped bundle for storage, sized for insertion into a skier's pocket.

In a preferred embodiment, described in greater detail below, the eyelet openings are formed by overlapping the strap end portions back on themselves. The length of overlap is preferably made less than the edge-to-edge width across the ski bottoms. This ensures self-adjustment of the sizes of the ski carrying loops defined by parts of the strap end portions that remain unthreaded through the eyelets. The temporary disconnecting means is preferably formed by securing connecting central parts of the intermediate portion through complementary male and female elements of a releasable closure mechanism, and the pole carrying tie loop is advantageously attached to the strap at one of the closure elements.

BRIEF DESCRIPTION OF THE DRAWINGS

Exemplary implementations of the apparatus and method of the invention are described below, with reference to the accompanying drawings, wherein.

Throughout the drawings, like elements are referred to by like numerals.

DETAILED DESCRIPTION OF PREFERRED EMBODIMENTS

Figure 1:
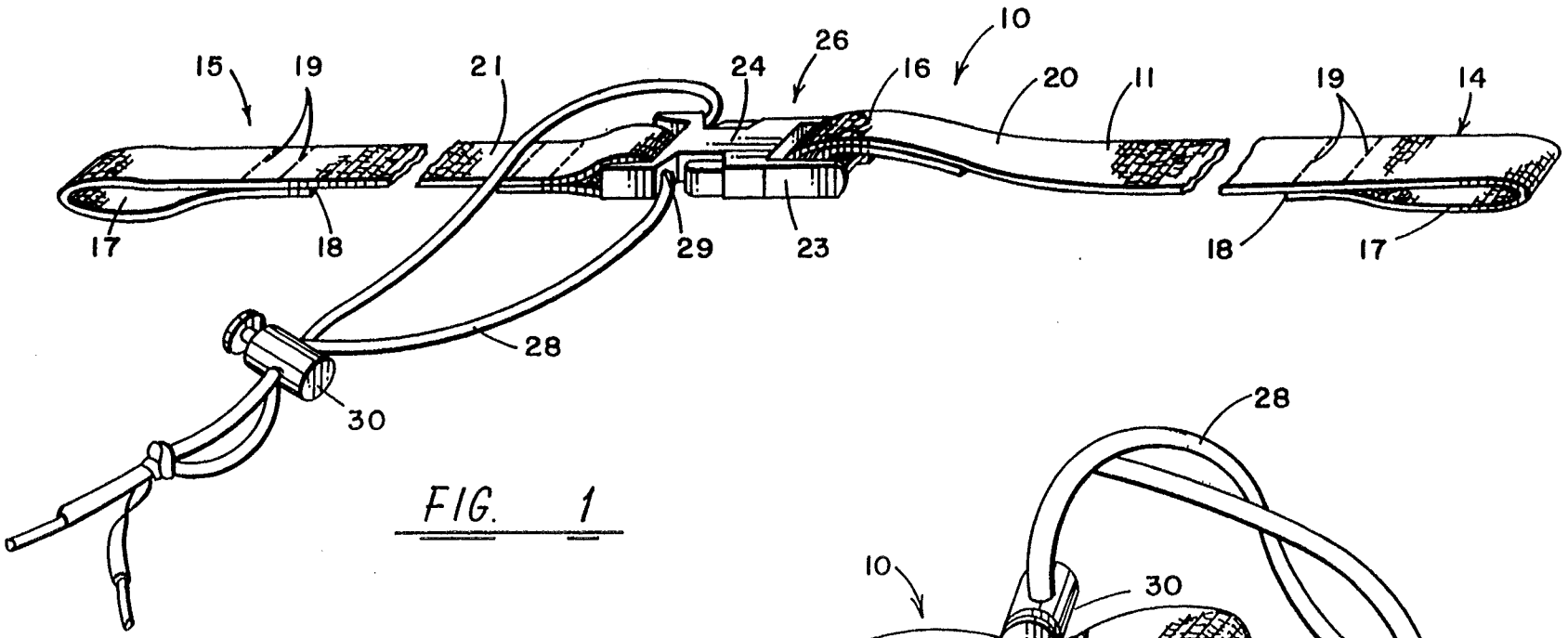
FIG. 1 is an overall perspective view of a ski carrier, in accordance with the invention, shown in an elongated, laid out position.

An exemplary ski carrier 10 in accordance with the invention comprises a strap 11 having opposite end portions 14, 15 joined by an intermediate portion 16. An eyelet opening 17 is formed at each end portion 14, 15 by overlapping the ends of strap 11 back over onto themselves, and securing strap extremities 18 to the overlapped layer, such as by sewing along lines 19, at points spaced inwardly by given distances from the extremities 18. The portion 16 comprises normally connected first and second segments 20, 21 respectively merged at distal ends by continuity of material into end portions 14, 15, and joined at proximal ends by respective attachment to normally connected male and female elements 23, 24 of a releasible fastening mechanism 26.

A tie loop 28 is secured by passage through an aperture 29 to one of the elements 23, 24. Means, such as a releasible locking mechanism 30, is associated with the tie loop 28 for selectively setting the size of the loop.

Figure 2A:
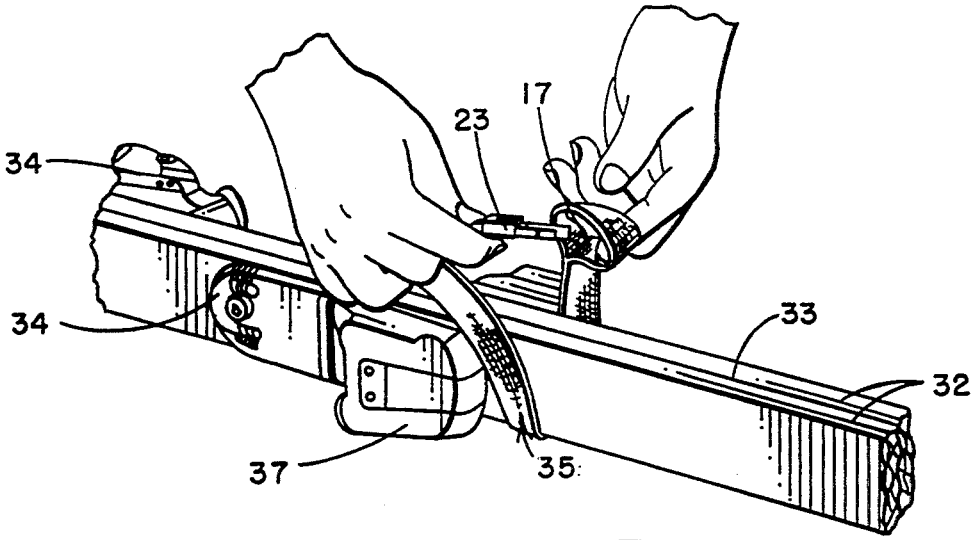
FIGS. 2A–2F are views showing successive steps in using the ski carrier of FIG. 1 to practice the method of the invention.
Figure 2B:
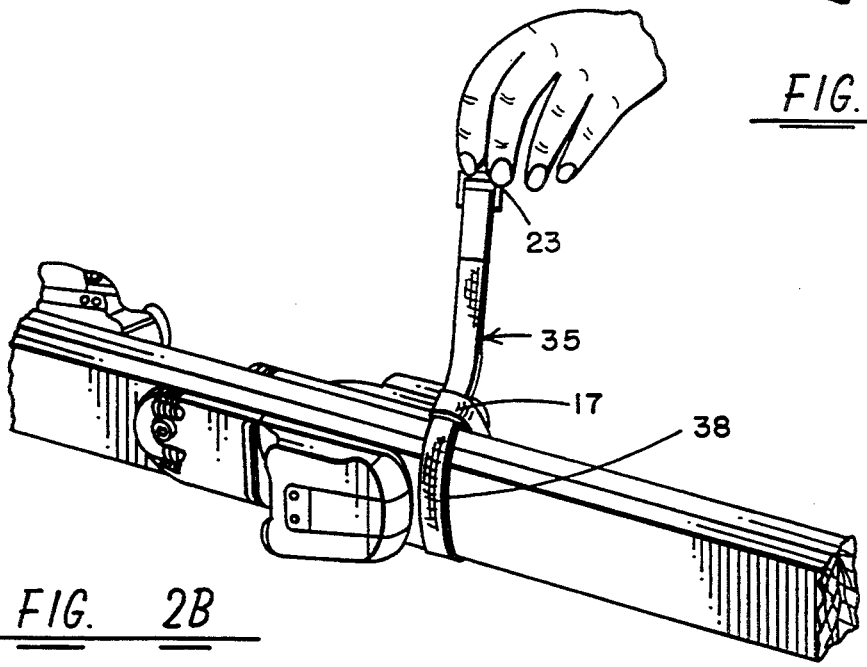
Figure 2C:
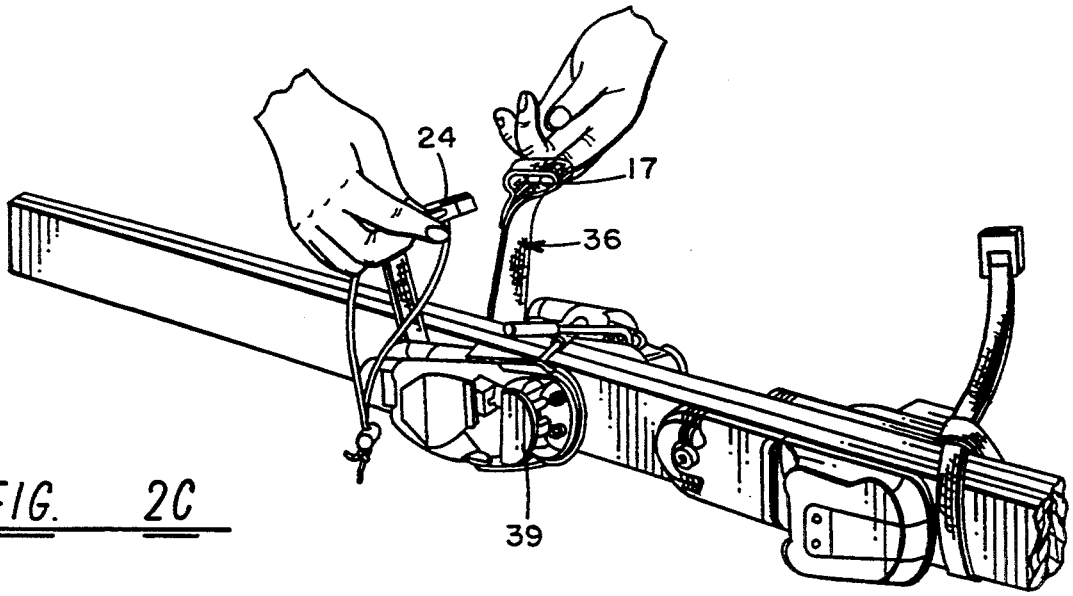

As shown in FIGS. 2A–2F, carrier 10 is dimensioned, configured and adapted for cooperation with a pair of conventional skis 32 aligned in tandem, back-to-back positions. The bottoms 33 of skis 32 are facing inwardly toward each other, and bindings 34 are facing out. Strap 11 is separated into two parts by disconnecting segments 20, 21 at the fastener 26. One part 35 (FIGS. 2A and 2B) comprises the end portion 14, the intermediate portion segment 20 and the fastener male element 23. The other part 36 (FIG. 2C) comprises end portion 15, segment 21 and fastener female element 24. One of the parts 35 is wrapped around the aligned skis 32 at a location slightly ahead of the binding toe-piece 37, and the fastener element 23 is threaded through eyelet opening 17 to form a first, toe-end ski carrying loop 38, as indicated in FIGS. 2A and 2B. Pulling up on element 23 (FIG. 2B) causes loop 38 to self-tighten around the skis, flattening the ski bottoms 33 together against the outward bias of the camber of the skis. The same process is repeated for the other part 36, as indicated in FIG. 2C, wherein the other strap part 36 is wrapped around skis 32 at a location just behind binding heel-piece 39. This time, the other fastener element 24 is passed through eyelet opening 17 of part 36 to form a heel-end ski carrying loop 40.

Figure 2D:
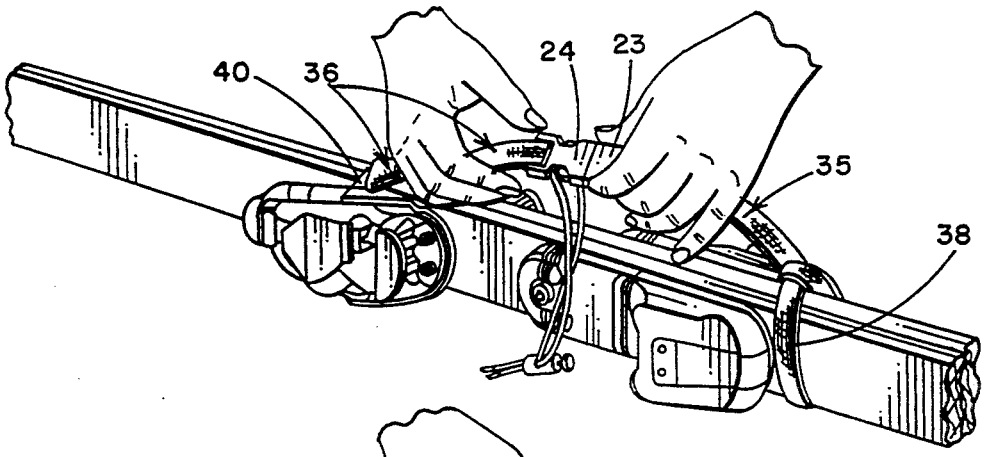
Figure 2E:
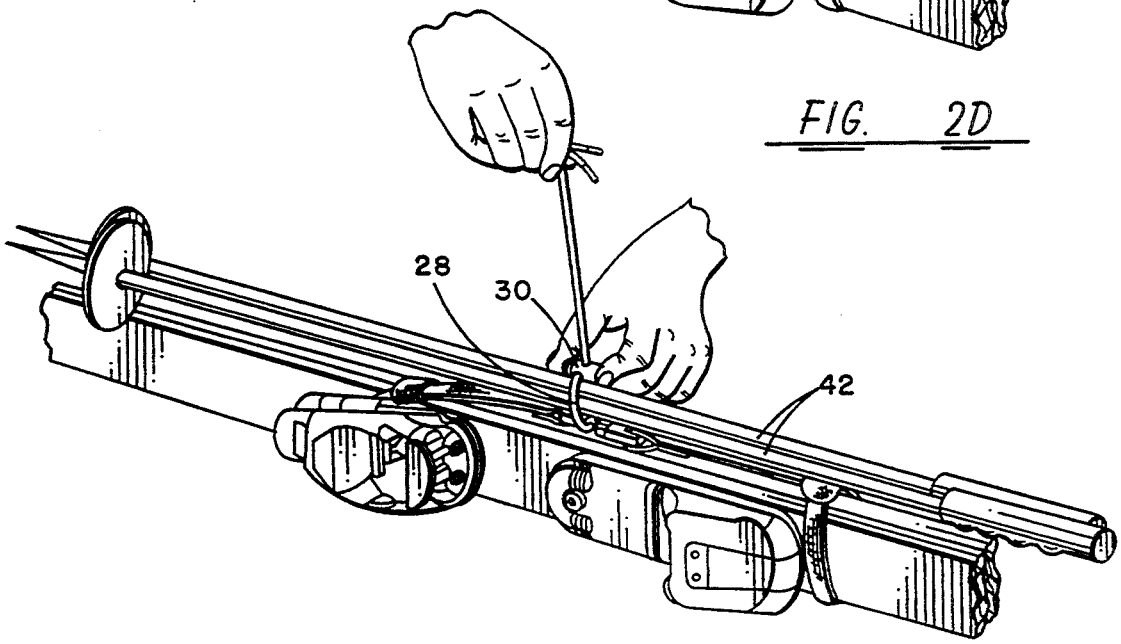

After forming the two ski carrying loops 38, 40 at their respective longitudinally spaced locations around skis 32, segments 20, 21 are again connected by mating fastener elements 23, 24 together, as indicated in FIG. 2D. Ski poles 42 are then brought into longitudinal alignment with skis 32 and inserted within the loop opening of tie loop 28. The size of the opening of loop 28 is then reduced to tighten loop 28 around poles 42. This is accomplished by sliding the locking mechanism 30 toward the associated element 23 or 24, as indicated in FIG. 2E.

Figure 2F:
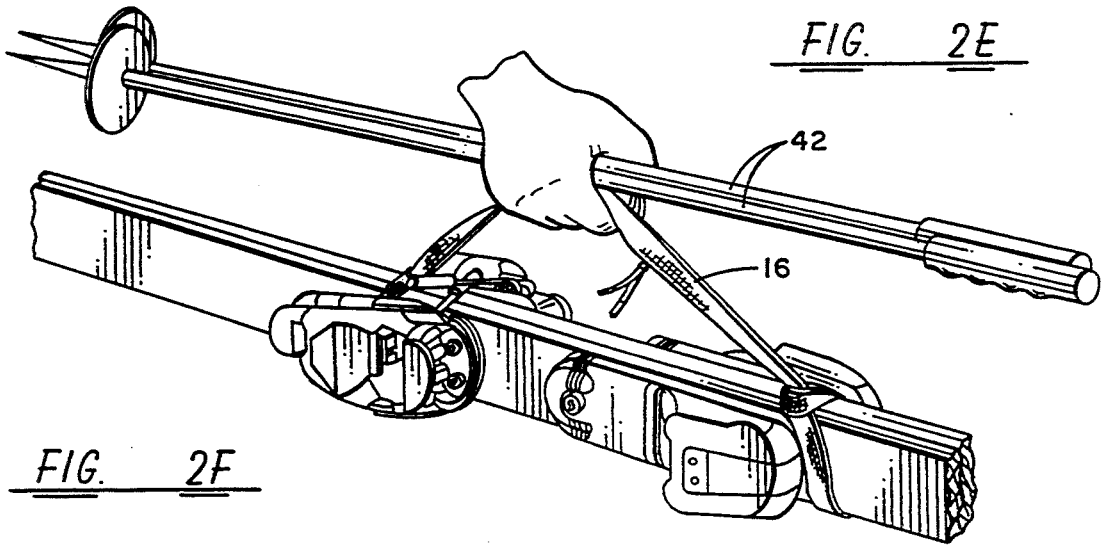

With the skis 32 thus passed through loops 38, 40 and the poles 42 secured within tie loop 28, the assemblage can then be lifted for carrying the skis and poles, as indicated in FIG. 2F. The skis are supported by grasping the center of portion 16 under the fastening mechanism 26, around poles 42 which pass through loop 28. The self-adjusting slip nature of loops 38, 40 causes strap 11 to cinch skis 32, to draw bottoms 33 together under the weight of the skis when strap 11 is lifted. The same construction allows the same loops to later loosen to separate the bottoms 33, under the biasing action of the ski curvature, when skis 32 are set down and the lifting force released.

Figure 3:
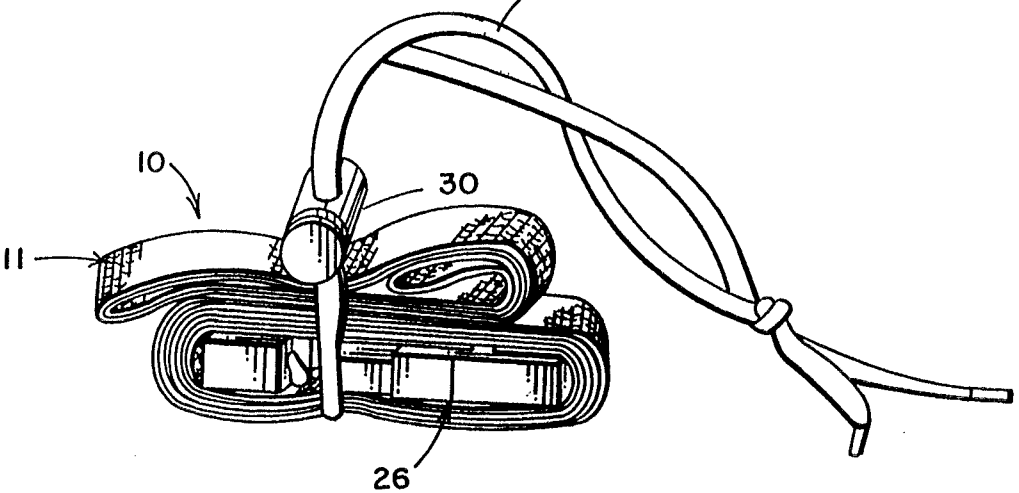
FIG. 3 is a view showing the pole tie loop in use for securing the carrier into a compact bundle for storage.

As shown in FIG. 3, when carrier 10 is not in use, strap 11 can be folded or wrapped against fastener 26 and locked in this position by passing the opening of tie loop 28 about the folded or wrapped configuration and drawing the locking mechanism 30 down tightly. This conveniently configures carrier 10 into a compact bundle for storage within a pocket.

Strap 11 can suitably be formed of single layer, 1" commercial nylon webbed strapping, doubled over at ends 14, 15 and sewn with bar tack stitching with 250-lbs. pressure, nylon thread #0069 along ¾" spaced lateral lines 19. Eyelets 17 are dimensioned so that the overlapping layer lengths are less than the edge-to-edge widths across the bottoms of conventional skis 32. For standard ski widths, the flattened double layer of strapping at each eyelet opening 17 is suitably dimensioned to be 2⅛". The eyelet opening should be large enough to permit easy passage of the 1" strapping width, but not so large that it impedes the self-tightening, self-loosening function. The proximal ends of the strapping of intermediate portion 16 are suitably joined by attachment to respective male and female elements 23, 24 of a quick-release buckle such as described in U.S. Pat. Nos. 4,150,464 and 4,171,555 and commercially available from ITW Nexis, Wood Dale, Ill. under the identification Fastex #SR1. Tie loop 28 can, for example, suitably be a plastic tipped shoestring which is passed through the locking aperture of the female element 24 and aligned openings of a locking mechanism 30 in the form of a spring-loaded ¼" barrel lock, available from Fastex, Des Plaines, Ill. The tipped ends of the shoestring are knotted together to keep the mechanism 30 on the string. A resilient member, such as a length of elastic shock cord, can be used in place of the shoestring and barrel lock for tying the poles or compacted strap bundle.

A ski carrier 10, as described, provides a compactly stowable, convenient apparatus for carrying skis and ski poles, which offers many advantages. The self-adjustment feature of the ski carrying loops cinches the skis tightly, thereby reducing ski camber sufficiently to prevent the skis from moving out of alignment with one another when carried bottom-to-bottom in either vertical or horizontal orientation. The skis return to the untensioned camber when the load is removed from the strap. Positioning the carrying loops on opposite sides of the binding, prevents the carrying loops 38, 40 from migrating longitudinally along the skis.

Use of a snapping fastener mechanism 26 like a quick release buckle, provides a positive "click" sound when male and female elements 23, 24 are mated. This informs the user that the strap segments 20, 21 are engaged and the carrier is ready to assume the load. Providing for temporary separation of the two parts of the strap enables each carrying loop 38, 40 to be separately formed, thereby eliminating any need to fix the extremities 18 each time the loop are formed. Prior art devices which form loops without parting the middle of the strap cannot leave the loops unfixed, so are unable to provide the self-adjusting feature of the inventive carrier. Use of the described quick release buckle permits adjustment of the length of the strap at the buckle to vary the length of the strap relative to the skis to achieve a comfortable balanced carrying position, adapted to each user's individual preference. For example, some users will prefer to carry the poles and strap close to the skis, while others will prefer to carry them at greater distance. A longer strap can be used that will even enable carrying over the shoulder.

Use of a tie loop such as a knotted shoelace for securing the poles and providing a compact bundle for storage, together with a locking mechanism such as a barrel lock, has the advantage of providing easy operation with no hard edges that can be safely stored in the pocket without injury to the skier.

The carrier of the invention is soft and non-bulky, permitting the user to leave the strap on the skis when using public transportation. Such accommodations typically have external ski holders which require vertical bottom-to-bottom placement of the skis. With the inventive carrier, the skier can place into and remove the skis from the holder in the vertical orientation simply by lifting up on the carrier.

Those skilled in the art to which the invention relates will appreciate that yet other substitutions and modifications can be made to the described embodiments, without departing from the spirit and scope of the invention as described by the claims below.

What is claimed is:

1. A ski carrier, comprising:

a strap having opposite end portions joined by an intermediate portion;

an eyelet opening formed at each end portion by overlapping said end portions back on themselves, and securing strap extremities to overlapped parts at points spaced inwardly by given distances from said extremities;

said intermediate portion comprising first and second segments having distal and proximal ends, said segments being respectively merged at said distal ends by continuity of material into said end portions;

a releasible fastening mechanism having normally connected male and female elements; respectively attached to said proximal ends and normally joining said segments;

a tie loop secured to one of said male and female elements and having a tie loop opening; and releasible locking means associated with said tie loop for selectively setting size of said tie loop opening.

2. A ski carrier as in claim 1, wherein one of said male and female elements includes an aperture; and said tie loop is secured to said one element by passage through said aperture.

3. A ski carrier as in claim 2, wherein said strap comprises nylon webbed strapping, with end doubled over and stitched along lateral lines at said points.

4. A ski carrier as in claim 3, wherein said given distance is less than 3" and more than 1".

5. A ski carrier as in claim 4, wherein said fastening mechanism comprises a quick-release buckle.

6. A ski carrier as in claim 5, wherein said tie loop comprises a lace; and said releasible locking means comprises a spring-loaded barrel lock.

7. In combination with a pair of skis longitudinally aligned in tandem, back-to-back positions; said skis having bottoms facing inwardly toward each other and bindings facing out, and having edge-to-edge widths across said bottoms; said bottoms having facing cambers and said bindings having first and second ends; a ski carrier comprising:

a strap having opposite end portions joined by an intermediate portion; said end portions having eyelet openings formed by overlapping said end portions back on themselves and securing strap extremities to overlapped parts at points spaced inwardly by given distances from said extremities; said intermediate portion comprising first and second segments having distal and proximal ends; and said segments being respectively merged at said distal ends by continuity of material into said end portions; and a releasible fastening mechanism having normally connected male and female elements respectively attached to said proximal ends and normally joining said segments;

said opposite end portions, segments and fastening mechanism elements defining two separable, normally connected parts of said carrier, each part comprising one end portion, one segment and one fastening mechanism element; one of said parts being wrapped around said aligned skis at a location ahead of said first ends of said bindings, with its associated fastening mechanism element threaded through its associated end portion eyelet opening to form a first ski carrying loop, and the other of said parts being wrapped around said aligned skis at a location behind said second ends of said bindings with its associated fastening mechanism element threaded through its associated end portion eyelet opening to form a second ski carrying loop;

said eyelet openings being relatively dimensioned and configured relative to said ski edge-to-edge widths so that when said carrier is lifted by said intermediate portion, said first and second ski carrying loops will self-tighten around said skis, flattening said ski bottoms together against an outward bias asserted by said cambers; and a pair of ski poles in longitudinal alignment with said skis; said ski carrier further comprising a tie loop secured to one of said male and female elements and including a tie loop opening; and releasable locking means associated with said tie loop for selectively setting size of said tie loop opening; said poles being passed through said tie loop opening, and said locking means setting said size so that said tie loop is tightened about said poles.

8. A combination as in claim 7, wherein said strap has a strap width, and wherein said given distances are greater than said strap width and less than said ski edge-to-edge widths.

9. A combination as in claim 8, wherein said given distance is $2\frac{1}{8}$".

10. A combination as in claim 8, wherein one of said male and female elements includes an aperture; and said tie loop is secured to said one element by passing through said aperture.

11. A combination as in claim 10, wherein said fastening mechanism comprises a quick-release buckle.

12. A combination as in claim 11, wherein said releasible locking means comprises a spring-loaded barrel lock.

* * * * *